United States Patent [19]

Marsh et al.

[11] Patent Number: 4,485,755

[45] Date of Patent: Dec. 4, 1984

[54] THREAD CUTTER IN SEWING MACHINE FACE PLATE

[75] Inventors: Walter H. W. Marsh, Scotch Plains; Kenneth D. Adams, Madison, both of N.J.

[73] Assignee: The Singer Company, Stamford, Conn.

[21] Appl. No.: 562,317

[22] Filed: Dec. 16, 1983

[51] Int. Cl.[3] ..... D05B 65/00

[52] U.S. Cl. ..... 112/292; 112/299

[58] Field of Search ..... 112/291, 292, 299

[56] References Cited

U.S. PATENT DOCUMENTS

| | | | |
|---|---|---|---|
| 1,195,834 | 8/1916 | Matthews . | |
| 1,883,746 | 10/1932 | Doubler | 112/292 |
| 1,999,978 | 4/1935 | Myers . | |
| 2,558,039 | 6/1951 | Carroll | 112/292 |
| 2,781,012 | 2/1957 | Kuhar . | |
| 2,867,184 | 1/1959 | Klapper . | |
| 3,108,557 | 10/1963 | Lober | 112/292 |
| 4,200,050 | 4/1980 | Bianchi | 112/292 |
| 4,325,316 | 4/1982 | Brauch et al. | 112/292 |

FOREIGN PATENT DOCUMENTS

| | | | |
|---|---|---|---|
| 1486939 | 1/1940 | Fed. Rep. of Germany . | |
| 745640 | 2/1974 | Fed. Rep. of Germany . | |
| 2840913 | 4/1979 | Fed. Rep. of Germany | 112/292 |
| 105848 | 9/1973 | German Democratic Rep. . | |
| 642111 | 12/1960 | Italy . | |
| 17470 | 10/1949 | Japan . | |
| 20945 | 7/1953 | Japan . | |

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A manual thread cutter for a sewing machine is disclosed in which a cutting blade is supported on a canted surface merging toward the corner of the hollow interior of a face plate covering the head end of the sewing machine. A slot extends continuously through adjacent walls of the face plate approximately medially of the canted surface so that sewing thread may be drawn through the slot to the cutting edge of the cutting blade. A platform extends from one of the adjacent walls coextensive with the bottom surface of the slot so that thread may be pivoted about the platform and drawn into the slot to impinge upon the cutting edge of the cutting blade.

5 Claims, 3 Drawing Figures

THREAD CUTTER IN SEWING MACHINE FACE PLATE

BACKGROUND OF THE INVENTION

This invention is in the field of sewing machines; more particularly, it is concerned with a thread cutter for a sewing machine.

In certain of the prior art, there are disclosed thread cutters which may be attached to existing sewing machines so that an operator may readily cut the thread extending from a stitched article without the necessity for locating scissors or other thread cutting implements. Such devices are disclosed in the U.S. Pat. No. 2,867,184 and in the Italian Patent No. 642111 as well as in the Japanese U.M. Application No. 17470. The former two devices are designed for attachment by the presser foot retaining thumb screw, and the Japanese U.M. application is designed for attachment to the sewing machine face plate above the sewing needle.

There is also disclosed in U.S. Pat. No. 1,195,834 of Mathews, a thread cutting blade having a lug extending through a slot in a bed slide, which lug may be used to deflect thread drawn therebeneath into the slot and to the cutting edge of the blade. However, being located on the sewing machine bed adjacent the stitching point, as it is, there may be some interference with progress of work material across the sewing machine bed. Also, a short thread end may result, which could cause unthreading of the sewing needle. The U.S. Pat. No. 2,781,012 of Kuhar, discloses a thread cutting slot cut into the presser bar bushing beneath the head of the sewing machine. However, great care must be exercised in cutting this slot to insure its effectivness in cutting the sewing machine threads. On the other hand, if the slot is effective to cut sewing threads, it might also be effective to cut an operator's finger drawn across that surface.

What is required is a thread cutter arrangement which is always effective for its intended purpose but does not adversely effect the appearance of the sewing machine. Ideally, the thread cutter should be concealed and inaccessible except by sewing thread for the sake of safety to prevent harm to an operator or user of the sewing machine.

SUMMARY OF THE INVENTION

The above requirements are obtained in an arrangement in which a thread cutting blade is retained in a sewing machine face plate behind a slot extending between two adjacent sides of the face plate. The cutting blade is supported on an inner surface of the face plate which is canted so that the thread cutting edge of the cutting blade is in the corner and approaches a normal to thread extending through the slot. The slot may be formed in the rear and side walls of the face plate, and inclined downwardly toward the front of the face plate. A platform is provided extending from the side of the face plate continuous with the lower edge of the slot, thereby providing an abutment for the thread to snag upon and providing a location for permitting ready egress of the thread into the slot to the thread cutting edge of the cutting blade. The slot may be made of such an opening as to permit ready entry of all threads of which the sewing machine is capable of using, but small enough to prevent entry of even the tiniest finger. Any convenient means may be provided for retaining the cutting blade on the canted surface of the face plate; in this case, a support bracket and shield for a sewing light is provided with an extension thereto which lies along and presses the cutting blade against the canted surface. The support bracket and shield may be retained to the face plate by any convenient means such as retaining washers about posts formed as part of the face plate and extending through apertures in the bracket and shield, or by swaging of the posts extending through the apertures, one providing better blade replacement then the other if deemed important.

DESCRIPTION OF THE PREFERRED EMBODIMENT

Figure 1:
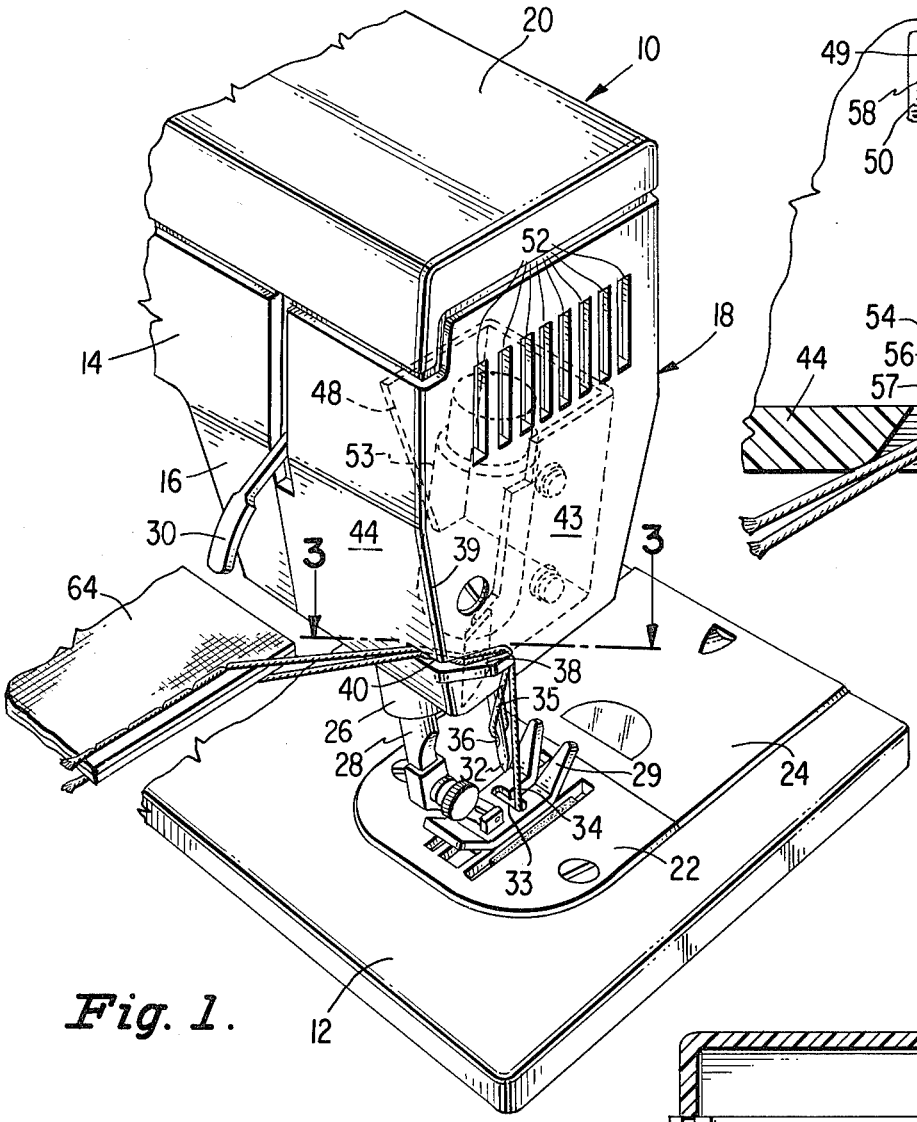
FIG. 1 is a rear perspective view of a portion of a sewing machine incorporating the present invention.

Referring to FIG. 1, there is shown a portion 10 of a sewing machine, including a bed 12, and an arm 14 and head end 16 overhanging the bed. The head end 16 of the sewing machine is closed off by contiguous walls of a face plate 18, and the arm 14 and face plate are covered by a top cover 20. The bed 12 supports thereon a throat plate 22 and bed slide 24 in any manner well known in the sewing machine art.

The head end 16 of the sewing machine carries a presser bar bushing 26 which slidably supports therein a presser bar 28 terminating in a presser foot 29. As is well known in the sewing machine art, the presser foot 29 may be elevated by a presser bar 30 or may be maintained as shown in the lowered position with the presser foot seated upon the throat 22 or against a work material situated between the presser foot and the throat plate. Situated forwardly of the presser bar 28 is a needle bar (not shown), which needle bar terminates in a sewing needle 32 that is urged to reciprocate in a manner well known in the sewing machine art, to extend through an orifice 33 in the presser foot 29 and through the work material and an aperture (not shown) in throat plate 22 to cooperate with sewing instrumentalities (not shown) in the bed 12 of the sewing machine. In FIG. 1, a lower or bobbin thread 34 is shown to extend from an under thread supply located in the bed 12 but not herein disclosed for the sake of simplicity, through the aperture (not shown) and orifice 33 of presser foot 29. An upper thread 35 is shown extending from an undisclosed source to the eye 36 of the sewing needle 32.

Figure 3:
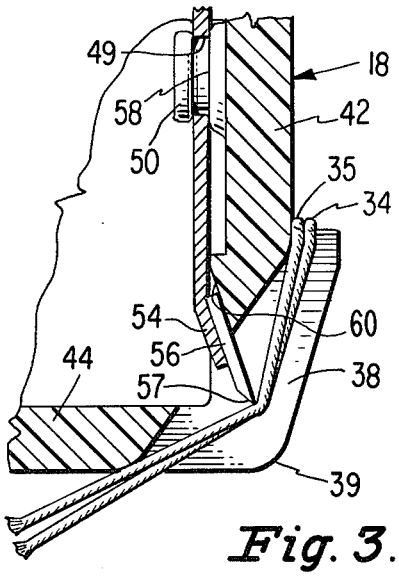

These threads 34, 35 are shown in FIG. 1 to extend upwardly to a platform 38 extending from the side of the face plate 18 and gradually merging to a rear corner 39 of the face plate (see also FIG. 3). The platform 38 is inclined upwardly to the rear corner 39 of the face plate 18, and extends inwardly of the face plate to form the bottom surface of a slot 40 extending through the side wall 42 and through the rear wall 44 of the face plate 18 to the interior thereof. The slot 40 thus extends through the side wall 42 and rear wall 44 of the face plate on both sides of the rear corner 39 thereof.

Figure 2:
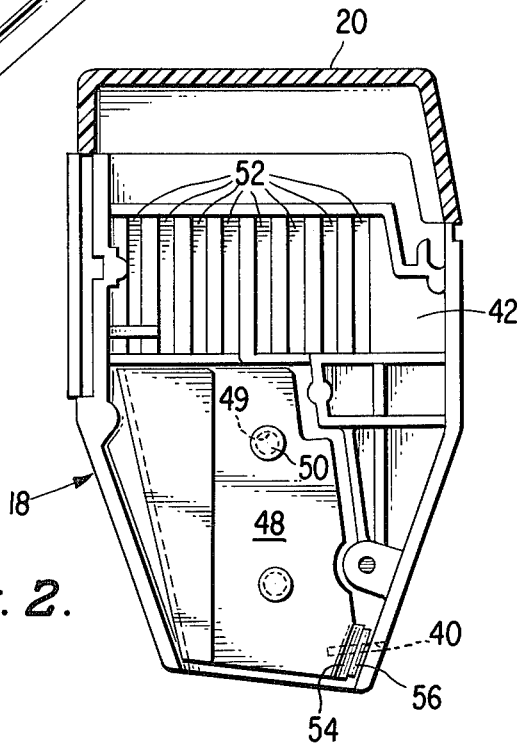
FIG. 2. is an elevation of the inside of the face plate to show the orientation of the thread cutting slot therein; and, FIG. 3 is a section taken substantially along line 3—3 of FIG. 1 to show the thread cutter as it appears when in use.

Referring now to FIG. 2, there is shown an inside elevation of the face plate 18 showing the support bracket and shield 48 affixed to the face plate by swaged posts 50 formed integrally with the face plate and extending through apertures 49 in the support bracket and shield. Cooling vents 52 may be cast or molded in the face plate 18 above the support bracket and shield 48. The support bracket and shield 48 is formed with a forwardly extending ear 54 which impinges upon a razor blade 56 trapped between the ear and the face plate 18. A light bulb 53 shown in phantom in FIG. 1 is upported internally of the support bracket and shield 48 beneath the cooling vents 52 so that any air heated by the light bulb may be dissipated through the cooling vents.

Referring now to FIG. 3, there is shown a cross section of the face plate 18 taken along the line 3—3 of FIG. 1 or, in other words, on the lower surface of the slot 40. There is shown the support bracket and shield 48 which rests upon raised surface 58 of face plate 18, from which raised surface the posts 50 extend through apertures 49 in the support bracket and shield. The posts 50 are swaged over to retain the support bracket and shield 48 firmly attached to the face plate 18. It is apparent that in place of swaging, retaining washers may be used. The ear 54 of the support bracket and shield 48 extends forwardly and is angled inwardly over a canted surface 60 of the face plate 18, that runs toward the corner 39 of the face plate. The slot 40 is spaced approximately medially of the canted surface 60 which is covered by ear 54 (see also FIG. 2). The cutting blade 56 is retained on the canted surface 60 by the ear 54 of the support bracket and shield 48 with the cutting edge 57 thereof at the corner 39. In FIG. 3, it is apparent that the upper thread 35 and bobbin thread 34 may extend upwardly to the platform 38, and pivot about the platform to slide into the slot 40 substantially normally to the cutting edge 57 of the cutting blade 56. This might be most readily effected as shown in FIG. 1, by lifting the work material 64 and directing the threads 34, 35 upwardly about the platform 38 to accomplish the severing of the threads a sufficient distance from the sewing needle 32 and the throat plate 22 to provide for enough thread end to avoid unthreading of the sewing needle.

Thus, a thread cutter for a sewing machine has been provided which effectively prevents operator injury, does not interfere with an asthetically pleasing appearance for the sewing machine, and reliably severs the thread by providing for a cutting edge substantially normal to the threads and at a distance from the sewing needle and throat plate to provide adequate thread ends to avoid unthreading of the sewing machine sewing instrumentalities.

From the foregoing description taken in connection with the accompanying drawings, the advantages of the construction and method of operation will be readily understood by those skilled in the art to which the invention apertains, and while I have described the principle of operation, together with the device which I now consider to be the best embodiment thereof, I desire to have it understood that the device shown is merely illustrative and that such changes may be made when desired as fall within the scope of the appended claims.

We claim:

1. A sewing machine comprising a frame including a head end and a face plate covering said head end, said face plate having contiguous walls defining a hollow interior for accommodating said head end, a slot extending continuously through a portion of adjacent of said contiguous walls having a common corner from the exterior of said adjacent walls to the hollow interior of said face plate, a surface on said hollow interior on one of said adjacent walls with said slot spaced medially of said surface, said surface canted with respect to said adjacent walls and extending from said common corner, a cutting blade on said canted surface, said cutting blade having a cutting edge extending to said common corner, and means for retaining said cutting blade on said canted surface, whereby a thread extended through said slot is severed by impinging on said cutting edge of said cutting blade.

2. A sewing machine as claimed in claim 1 wherein said slot is of an opening to accommodate sewing threads only.

3. A sewing machine as claimed in claim 1 further comprising a platform extending from said face plate on the exterior of one of said adjacent walls, said platform being coextensive with the bottom surface of said slot, whereby sewing thread may extend to said platform as a pivot point and slide along said platform to said slot and said cutting edge of said cutting blade.

4. A face plate for a sewing machine having a frame and a head end, said face plate having contiguous walls defining a hollow interior for accommodating said head end, a slot extending continuously through a portion of adjacent of said contiguous walls having a common corner from the exterior of said adjacent walls to the hollow interior of said face plate, a surface on said hollow interior on one of said adjacent walls with said slot spaced medially of said surface, said surface canted with respect to said adjacent walls and extending from said common corner, a cutting blade on said canted surface, said cutting blade having a cutting edge extending to said common corner, and means for retaining said cutting blade on said canted surface, whereby a thread extended through said slot is severed by impinging on said cutting edge of said cutting blade.

5. A face plate as claimed in claim 4 further comprising a platform extending from said face plate on the exterior on one of said adjacent walls, said platform being coextensive with the bottom surface of said slot, whereby sewing thread may extend to said platform as a pivot point and slide along said platform to said cutting edge of said cutting blade.

* * * * *